United States Patent [19]

Huss et al.

[11] 4,310,395

[45] Jan. 12, 1982

[54] PROCESS FOR ELECTROLYTIC RECOVERY OF NICKEL FROM SOLUTION

[75] Inventors: Rainer Huss, Kirchheim; Werner Peters, Ostfildern, both of Fed. Rep. of Germany

[73] Assignee: SEP Gesellschaft fur technische Studien Entwicklung Planung mbH, Munich, Fed. Rep. of Germany

[21] Appl. No.: 193,606

[22] Filed: Oct. 3, 1980

[30] Foreign Application Priority Data

Oct. 8, 1979 [DE] Fed. Rep. of Germany ..... 2940741

[51] Int. Cl.[3] ..... C25C 1/08

[52] U.S. Cl. ..... 204/112

[58] Field of Search ..... 204/112, 113

[56] References Cited

U.S. PATENT DOCUMENTS 4,073,709 2/1978 Pittie et al. ..... 204/113

4,204,922 5/1980 Fraser et al. ..... 204/113

*Primary Examiner*—R. L. Andrews

*Attorney, Agent, or Firm*—Strimbeck, Davis & Soloway

[57] ABSTRACT

The present invention provides a method for electrolytically recovering or winning pure metallic nickel from nickel sulfate-containing solution using an electrolysis cell having nickel electrodes. The cell has at least one anode space, at least one cathode space and a diaphragm disposed therebetween. Certain of the nickel electrodes are employed alternatively as anode electrodes and as cathode electrodes in the anode and cathode spaces, respectively, while maintaining other electrodes as fixed cathode electrodes in the cathode spaces for electro-winning of nickel. Nickel regenerated using the process of the present invention may be employed as anode material in nickel electroplating processes.

9 Claims, 2 Drawing Figures

PROCESS FOR ELECTROLYTIC RECOVERY OF NICKEL FROM SOLUTION

Figure 1:
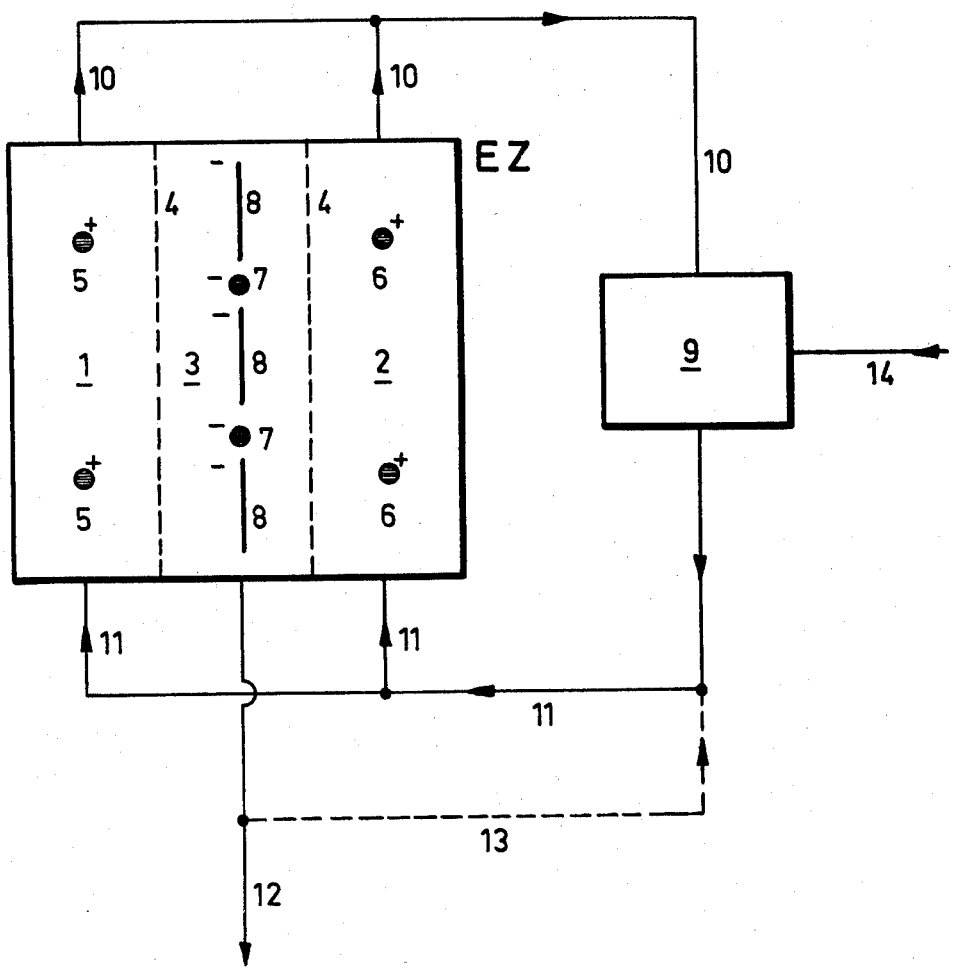

The present invention relates to a process for the recovery or winning of nickel from a solution containing same, and more particularly, to a process for the electrolytic recovery or winning of metallic nickel from solution.

Electrolytic processes for the recovery or winning of metallic nickel from nickel salt-containing solutions are wellknown in the art and have been employed for a number of years in electrolytic metal processing industries, particularly in the nickel-electroplating industry. In recent time, due to a concern for conserving raw materials and for protecting the environment, there has been an increased interest in materials recovery and recycle, particularly in the galvano-technical industrial field. Prior art methods for recovering and recycling nickel in nickel-electroplating industry generally have been directed toward returning to the nickel bath after processing, as a nickel salt or ion by means of precipitation or ion exchange technique, materials that otherwise would have settled out of the nickel bath in the form of a useless slurry which was detrimental to the environment (see *Galvano-Technik* 69, pages 7 to 15, (1978). A technical problem of such prior art methods is to control nickel concentration in the nickel electrolyte. This problem is accentuated by the fact that in the nickel bath the anodic current yield for nickel decomposition approximates 100%, while cathodic current yield for nickel coating generally is only about 95%.

If, as has been hitherto most usual, the materials settling out from the nickel baths are discarded, preferably as a mixed slurry after neutralization, the nickel content of the nickel bath can be kept stationary. On the other hand when all the nickel is recovered, e.g., by ion exchange, and recycled to the nickel bath, there necessarily results a continuous increase of nickel content of the bath. Should nickel concentration in the bath exceed a certain limit, satisfactory nickel transfer to the article may no longer be obtained. Thus a large portion of the materials settling from the nickel bath must be discarded or lost despite the possibility of recycling the nickel as salt, or insofar as possible, removed from the bath by cleaning the bath with activated charcoal. Cleaning the bath with charcoal is a costly process and one which requires special handling and also has the disadvantage of being detrimental to the environment due to the large amounts of nickel-precipitate containing slurry generated.

It has been proposed to recycle nickel to the nickel bath as pure metal rather than in the form of ion or a salt. This latter process is based on reducing the nickel from ionic to metallic form. Electrolytic processes lend themselves to recovery of metallic nickel as potentially being least costly, and as having the least adverse effect on the environment. (see "Electrolytic Metal Recovery Economy and Practical Use," *Galvano-Technik* 70, pages 596–603,[1979]).

In order to assure complete recovery and recycling of nickel, a nickel electroplating bath for continuous operation should be coupled with electrolytic recovery of the nickel. However, prior art attempts to electrolytically recover nickel on a commercial scale have not been fully successful.

Two basic requirements for electrolytic recovery of nickel on a commercial scale are: (1) to protect the environment, generation at the anode of primarily oxygen only, with little or no generation of chlorine or other poisonous or corrosive gases; and (2) the nickel recovered must be as pure as possible. As a practical matter the first requirement (1) effectively limits the electrolyte to a sulfate ($SO_4^{2-}$) containing electrolyte composition so that in the past only acid sulfate electrolytes were employed. However, for use with acid sulfate electrolyte baths only lead anode electrodes are known to perform satisfactorily as so-called "insoluble" or "dimensionally-stable anodes" (see *Galvano-Technik*, W. Pfauhanser, Leipzig, 1941, Vol. 1). A problem with employing lead anodes in the electrolytic recovery of nickel is that the lead erodes rapidly in the presence of the nickel acid sulfate electrolyte, producing a finely divided colloidal lead dioxide that contaminates the cathodically precipitated nickel. Dimensionally stable anode electrodes of Pt/Ti, $RuO_2$-$TiO_x$/Ti and $PbO_2$/Ti have also been considered for use in electrolytic recovery of nickel, and while such anodes are less prone to erosion, they do erode to some degree and thereby do contaminate the cathodically precipitated nickel. Moreover, such electrodes are extremely expensive. It has also been proposed to employ graphite anode electrodes in electrolytic recovery of nickel; however, graphite anodes also erode in the presence of acid sulfate electrolyte and thus cannot be satisfactorily employed.

As to the second requirement (2) high purity of the nickel is indispensible in many technical fields of use, and in particular ganvano-technical fields. However, as noted supra, corrosion of the anode electrodes in the electrolytic recovery of the nickel may result in the co-precipitation of corrosion products in the cathodically precipitated metal. By way of example, in the case where lead anode electrodes are employed for the electrolytic recovery of nickel from a nickel sulfate electrolyte, erosion of the anodes and co-precipitation of the resulting corrosion products may result in a lead content in the cathodically precipitated recovered nickel in excess of 0.1% by weight. Such amount of lead impurity renders the recovered nickel unusable for use in a subsequent nickel-electroplating process.

It is thus an object of the present invention to provide a method for recovering nickel from nickel salt-containing solutions which overcomes the aforesaid problems and disadvantages of the prior art. A more specific object of the present invention is to provide a simple, relatively low cost and reliable method for recovering high-purity metallic nickel from a nickel-salt containing aqueous solution.

In order to effect the foregoing and other objects, the present invention provides a method for electrolytically recovering substantially pure metallic nickel from nickel sulfate-containing solution using an electrolysis cell having nickel electrodes. The cell has at least one anode space, at least one cathode space and a diaphragm disposed therebetween. Certain of the nickel electrodes are employed alternatively as anode electrodes and as cathode electrodes in the anode and cathode spaces, respectively, while maintaining other electrodes as fixed cathode electrodes in the cathode space.

Yet other objects of the invention will in part appear obvious and will in part appear hereinafter. The invention accordingly comprises the method comprising the various steps and relation of one or more of such steps with respect to each other, all of which are exemplified in the following description and the scope of the application as will be indicated in the claims.

Figure 2:
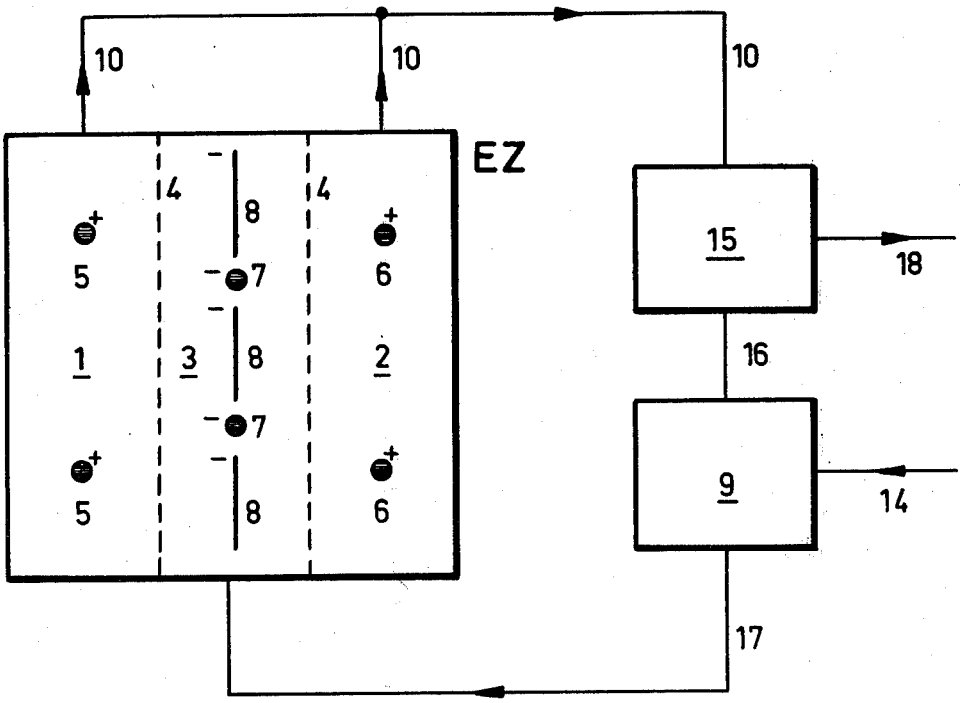

For a further understanding of the nature and objects of the present invention, reference should be had to the following detailed description taken in connection with the accompanying drawings wherein like numerals denote like parts, and wherein:

FIG. 1 is a schematic flow diagram of an electrolytic processing system in accordance with the present invention, in an open cycle processing system; and FIG. 2 is a schematic flow diagram of an electrolytic processing system in accordance with the present invention, in a closed cycle processing system.

Referring to FIG. 1 of the drawings, there is shown an electrolysis cell employed in one embodiment in accordance with the present invention in an open cycle process. The electrolysis cell includes an electro-chemical cell EZ which is divided by diaphragm 4 into a left anode space 1, and a right anode space 2, having a cathode space 3 therebetween. Disposed within anode spaces 1 and 2 are a plurality of non-stationary nickel electrodes 5 and 6 as anodes. A plurality of fixedly disposed or stationary cathode electrodes 8 are disposed within cathode space 3. Also disposed within cathode space 3 and located between stationary cathodes 8 are non-stationary nickel electrodes 7. As seen in FIG. 1 cathodes 8 preferably comprise elongate flat members. Cathodes 8 may comprise flat nickel plates or they may be flat plates of other metal such as fine steel.

Also forming a part of the system, is an electrolyte regenerator unit 9 for concentrating and controlling nickel concentration and controlling pH value in the anolyte. The latter is connected to anode spaces 1 and 2 via pipelines 10 and 11. In operation anolyte from left anode space 1 and right anode space 2 is withdrawn from the electrolysis cell EZ and supplied via discharge pipelines 10 to regenerator unit 9. The latter is supplied with sulfuric acid and nickel hydroxide or concentrated nickel salt in solution, e.g., in the form of nickel sulfate from a supply source (not shown) via a line 14. In electrolyte regenerating unit 9 the anolyte is mixed with sufficient quantities of concentrated nickel salt to produce a desired nickel concentration, and the resulting regenerated anolyte is returned to anode spaces 1 and 2 via pipelines 11. Electrolyte regenerating unit 9 per se is of conventional construction, and therefore will not be further described.

In operation, the open cycle system is as follows: Nickel electrodes 5 and 6 are energized in anode spaces 1 and 2, respectively, at a current density and a composition of electrolyte that effects a "passivation" or electropolishing of the nickel electrodes. Under appropriate electrochemical potential and current density conditions and composition of the electrolyte the surfaces of anode electrodes 5 and 6 can be electropolished gleamingly metallically pure, with no non-conducting oxide being formed on the surfaces. The electrolyte in anode spaces 1 and 2, which comprises nickel sulfate aqueous solution, preferably contains between about 30 and 70 grams per liter of nickel. The anolyte preferably is adjusted to a pH value in the range of from about pH 1 to about pH 2 using sulfuric acid. In order to insure against the generation of chlorine gases, the anolyte should have as low a chlorine content as possible. Preferably chloride ion should be less than 2 grams per liter. Anodic current density preferably is maintained at values greater than about 10 $A/dm^2$. Under these process conditions, oxygen is generated at anode electrodes 5 and 6, and the current density yield based on nickel decomposition amounts to between about 3 and about 8%, depending on temperature, pH of the anolyte, and chloride ion content of the anolyte.

The electrolyte in cathode space 3 is somewhat less concentrated in nickel ion than that in the anode spaces 1 and 2, depending on the permeability of diaphragm 4. Preferably concentration in cathode space 3 will be between about 3 and about 10 grams per liter less than in anode spaces 1 and 2, and the pH of the solution in cathode space 3 generally will be somewhat higher, typically from about 1.8 to about 3.0, i.e., about one unit of pH higher in value than in anode spaces 1 and 2. The differences in nickel ion content and pH settle after a short time to substantially constant values as a result of the electrochemical operations being carried out in the electrochemical cell EZ. Generally, the cell should be maintained with an internal temperature in the range of about 30 to about 60 degrees C.

As noted supra cathode electrodes 8 are fixedly disposed within cathode space 3. Typically cathode electrodes 8 comprise sheet steel or a porous steel plate. Non-stationary nickel electrodes 7 are disposed within cathode space 3 between fixedly disposed electrodes 8. Both cathode electrodes 8 and nickel electrodes 7 to be regenerated are electrochemically plated with substantially pure metallic nickel using the aforementioned nickel sulfate electrolyte, at a cathodic current density in the range of about 2 to about 5 $A/dm^2$, with a cathodic current yield based on nickel deposition in the range of about 75 to 95%.

The overall process is as follows: Nickel plated electrode or electrodes 7 to be regenerated are disposed in cathode space 3, and current is applied for a sufficient period of time so that substantially the same amount (by mass) of nickel lost by anode electrodes 5 or 6 in the anode spaces 1 or 2 under anodic polarity is electrodeposited on electrodes 7. Electrodes 7 are then removed from cathode space 3 and exchanged with anode electrodes 5 and 6 in one of the spaces 1 or 2, respectively, with the eroded nickel anode electrodes from anode spaces 1 or 2 being inserted in the free spaces in cathode space 3 between cathode electrodes 8. The process is then repeated; however, the intermediate activation of electrodes to be regenerated generally is not needed.

In order to maintain materials (nickel) balance, cell EZ should be dimensioned so that anodic erosion of the nickel anode electrodes 5 and 6 in anode spaces 1 and 2 takes twice as long as the electrodeposition, i.e. regeneration of the nickel electrodes in cathode space 3.

The composition and pH of the anolyte is maintained substantially constant by continuously withdrawing anolyte from anode spaces 1 and 2 via pipelines 10, and passing the withdrawn anolyte to regenerator unit 9 where it is mixed with a suitable amount of concentrated nickel sulfate solution and sulfuric acid supplied via line 14 from a supply (not shown) to concentrator unit 9. The regenerated anolyte is then returned to anode spaces 1 and 2 via a pipeline 11. At the same time a suitable amount of catholyte is withdrawn from cathode space 3 via line 12 and, if desired, may be passed to a nickel electroplating system (not shown).

One skilled in the art will recognize that with the foregoing method, it is possible, in successive erosion-nickelling working cycles of the anodes, alternatively to regenerate left and right anode electrodes 5 and 6, respectively. Thus, by regular suitable replacement of the anode electrodes in spaces 1 and 2, respectively, it is possible to achieve substantially continuous operation with a small number of anodes in constant use.

As should be clear from the foregoing maintaining the pH value and the nickel ion concentration of the catholyte within the aforesaid preferred ranges in cell EZ give no problems by mixing the catholyte with the nickel electrolyte of the galvanic bath. A volume amount of anolyte liquid equal to the volume amount of catholyte liquid discharged from the cathode space 3 through the pipeline 12 substantially immediately permeates as anolyte liquid from anode spaces 1 and 2 through diaphragm 4 into cathode space 3. Thus, the pH adjustment in cathode space 3 will be stabilized in a self-regulating manner to a pH value in the range of about 1.8 to about 3.0 in the continuous operation of the above described system. If required, a bypass pipeline 13 may be provided in the electrolytic process system as shown in phantom in FIG. 1. This latter modification is desirable, when electrochemical cells having a high space-time yield are used, to prevent a significant reduction in nickel concentration of the catholyte.

The nickel deposited on these stationary cathodes in accordance with the present invention is very pure and ductile, and can be used directly without problem as anode material in a nickel electroplating system. The prior art problems of foreign metals inclusion in the anodes, e.g. lead, ruthenium, platinum, etc. which resulted when using these metals as so-called insoluble anodes, which inclusion prevented the use of the recovered nickel as anode material in nickel electroplating system cannot occur with the process of the present invention since only nickel anodes are employed as the "insoluble" anodes.

FIG. 2 shows a closed cycle system in accordance with the present invention. The electrolysis cell EZ shown in FIG. 2 is identical to Cell EZ shown in FIG. 1, and has a left anode space 1, a right anode space 2 with a cathode space 3 located therebetween. As before the anode spaces 1 and 2 are separated from the cathode space 3 by a diaphragm 4. Also as before nickel anode electrodes 5 and 6 are disposed in anode spaces 1 and 2, respectively, and non-stationary nickel electrodes 7 to be regenerated are disposed in the cathode space 3 between fixedly disposed cathode electrodes 8. Also included is an electrolyte regenerator unit 9, as before. However the FIG. 2 system also includes a vaporizing unit 15 for vaporizing electrolyte for reasons as will become clear from the following. Electrolyte regenerator unit 9 and electrolyte vaporizing unit 15 are connected to one another by a pipeline 16. Regenerator unit 9 is connected via a pipeline 17 with cathode space 3 and thus provides an inlet to the cathode space. Pipelines 10 in turn carry discharge from the anode spaces 1 and 2 to the vaporizing unit 15. Completing the closed cycle system in accordance with FIG. 2 is a pipeline 14, which connects regenerator unit 9 to a source of nickel hydroxide (not shown) and a vent line 18 connected to vaporizing unit 15 for venting vapor to the atmosphere.

Operation of the Fig. closed cycle system is as follows:

Electrolyte is withdrawn from anode spaces 1 and 2 via pipeline 10 and passed to vaporizing unit 15 where a portion of its water content is evaporated. Then the electrolyte with a concentration of preferably 30 to 60 g/l nickel will be concentrated to preferably 40 to 80 g/l nickel content. The sulfuric acid content of the resulting concentrated electrolyte is measured in known manner and the pH is adjusted to a pH value of preferably 1.8 to 3.0. pH adjustment is made by adding nickel hydroxide as required via pipeline 14. As before, the chloride content of the electrolyte is maintained at less than 2 g/l. The concentrated, pH adjusted electrolyte is then returned to cell EZ cathode space 3 via pipeline 17, where it is electrolytically stripped of nickel, preferably to a concentration which is 10 g/l lower than before. Simultaneously, with the withdrawal of electrolyte from anode spaces 1 and 2, electrolyte from cathode space 3 passes through diaphragm 4 into anode spaces 1 and 2, wherein its pH value is lowered to about pH 1 to about pH 2. Electrolyte is withdrawn from anode spaces 1 and 2 via pipelines 10 as before, and passed again into vaporizing unit 15. Cell EZ is operated as in the FIG. 1 open cycle system.

In vaporizing unit 15 water entrained in the electrolyte circuit by the OH groups of the nickel hydroxide, and moisture adhering to the nickel hydroxide is vaporized. If desired, part of the heat requirements for vaporizing unit 15 may be supplied from the current heat generated in electrolysis cell EZ. Typically, vaporizing unit 15 will comprise a conventional vaporizing unit as are well known in the art, e.g. and may work by spraying electrolyte into the air. Any sodium sulfate which might be entrained by precipitation of the nickel hydroxide with caustic soda, and which may eventually accumulate in the electrolyte circuit without disturbing the electrochemical process, can be "frozen out" after vaporization and cooling of the electrolyte, and be removed to a large extent.

The quality of cathodically deposited nickel obtained using the FIG. 2 closed cycle system is the same as that obtained using the open system according to FIG. 1 and may be used directly as anode material in a nickel electroplating process. However, a special field of use for nickel recovered in the closed cycle system of FIG. 2 is where a quantitative conversion of nickel in ion form to nickel in metal form is desired, as for example in the smelting of nickel.

As should be clear from the foregoing the instant invention provides a novel and simple process for electrolytically recovering or winning high purity nickel from nickel-salt containing solutions. The nickel recovered is quite pure and ductile, and can be used directly, without any problem, as anode material in a nickel electroplating process. Foreign metals inclusion, e.g. lead, ruthenium, platinum, etc., which resulted from the use of conventional insoluble anodes in prior art electrolytic recovery of nickel, and which prevented the use of nickel so recovered as anode material in a nickel electroplating process fundamentally cannot occur using the process of the present invention. Moreover, the anodes used in the present invention are relatively low cost, and as extensive experiments have shown, can be used for numerous working cycles. Moreover, the process according to the invention can be conducted in an open cycle or in a closed cycle without affecting the quality of the nickel recovered.

Certain changes will be obvious to one skilled in the art and may be made in the above disclosure without departing from the scope of the invention herein involved. For example, while cell EZ has been shown as comprising two anode spaces 1 and 2, and one cathode space 3, the cell could have any number of anode and cathode spaces. Moreover, fixedly positioned cathodes 8 may take a variety of forms other than as specifically depicted.

What is claimed is:

1. A method for the electrolytic recovery of metallic nickel from nickel sulfate-containing solution in an electrolysis cell having at least one cathode space with at least one cathode electrode therein, and at least one anode space with at least one anode electrode therein, said at least one anode space and said at least one cathode space being separated from one another by a diaphragm, said method comprising extracting metallically pure nickel from said nickel sulfate solution by electrodepositing said nickel on moveable nickel electrodes disposed, along with fixedly positioned cathode electrodes for electrowinning of nickel, in said at least one cathode space, and using said moveable nickel electrodes alternatively as anode electrodes and as cathode electrodes in selected ones of said anode and cathode spaces, repeatedly, while maintaining unchanged the polarity within said spaces.

2. A method according to claim 1, wherein said anodic current density is such as to produce a relatively low anodic current yield based on anodic nickel erosion, and said cathodic current density is such as to produce a cathodic current yield based on cathodic nickel coating which is considerably higher than said anodic current yield based on said anodic nickel erosion, that after partial anodic decomposition of said moveable nickel electrodes in said anode space, including the steps of cathodically nickelling, said eroded moveable nickel electrodes are substantially nickelled in said cathode space to their original thickness prior to said anodic erosion, thereafter removing said resulting nickelled electrodes from said cathode space and employing said resulting nickelled electrodes as anode electrodes in said anode space, and repeating said anodic nickel erosion and cathodic nickelling of said moveable nickel electrodes, in cycle.

3. A method according to claim 2, wherein said anodic nickel erosion proceeds at a rate which is substantially half the rate of said cathodic nickelling.

4. A method according to any one of claims 1, 2 and 3, which comprises energizing said moveable nickel electrodes and also fixedly positioned anode electrodes in said anode spaces with a current density such as to effect a passivation of the surface of said moveable nickel electrodes, said current density having a value of 10 $A/dm^2$ and an anodic current yield based on nickel decomposition in the range of from 3 to 8%, energizing said fixedly positioned cathode electrodes for electrowinning of nickel and said moveable nickel electrodes in said cathode space with a cathodic current density in the range of 2 to 5 $A/dm^2$ and a cathodic current yield based on nickel precipitation of 75 to 95%, and, electrodepositing cathodically onto said moveable nickel electrodes an amount of nickel equal to that eroded anodically from said moveable nickel electrodes.

5. A method according to claim 4, wherein the concentration of the electrolyte in said anode space is maintained at 30 to 70 g/l nickel, $<2$ g/l chloride, and has a pH value in the range of 1 to 2, and the concentration of the electrolyte in said cathode space is maintained at 20 to 60 g/l nickel, and has a pH value in the range of 1.8 to 3.0.

6. A method according to claim 5, including the step of withdrawing electrolyte from said anode space, adjusting the nickel concentration and pH of the electrolyte withdrawn from said anode space by the addition of sulphuric acid and nickel hydroxide or of nickel sultate solution, and reintroducing said adjusted electrolyte into said anode space so as to maintain said concentration and pH value within said cathode space, and withdrawing electrolyte from said cathode space, and replacing electrolyte withdrawn from said cathode space with electrolyte passing from said anode space across said diaphragm so as to maintain said concentration and pH value within said cathode space.

7. A method according to claim 4, including the step of withdrawing electrolyte from said anode space and passing said withdrawn electrolyte to a vaporizer wherein a portion of its water content is vaporized and the electrolyte is concentrated, and then passing said concentrated electrolyte to a device wherein a portion of its sodium sulfate content is "frozen out" and then adjusting the pH value and nickel concentration of said resulting concentrated electrolyte by addition thereto of sulfuric acid and nickel hydroxide or of concentrated nickel sulfate solution, introducing said pH and nickel concentration adjusted electrolyte into said cathode space so as to maintain therein a nickel concentration of 40 to 80 g/l and a pH value in the range of 1.8 to 3.0, and replacing electrolyte withdrawn from said anode space with electrolyte passing from said cathode space across said diaphragm.

8. A method according to claim 1 or 2, in open cycle, and including the step of replacing selected of said moveable nickel electrodes with other nickel electrodes following said partial anodic decomposition.

9. A method according to claim 1 or 2, in closed cycle, and including the step of subjecting all of said moveable nickel electrodes to cathodic nickelling following partial anodic decomposition.

* * * * *